US005996633A

United States Patent [19]

Kato

[11] Patent Number: 5,996,633

[45] Date of Patent: Dec. 7, 1999

[54] HEAT-EXCHANGING CONDUIT TUBES FOR LAMINATED HEAT EXCHANGER AND METHOD FOR PRODUCING SAME

[75] Inventor: Soichi Kato, Saitama, Japan

[73] Assignee: Zexel Corporation, Tokyo, Japan

[21] Appl. No.: 08/535,901

[22] Filed: Sep. 28, 1995

[30] Foreign Application Priority Data

Sep. 30, 1994 [JP] Japan ..... 6-238242

[51] Int. Cl.[6] ..... F15D 1/02; F28F 3/00

[52] U.S. Cl. ..... 138/38; 138/116; 138/142; 138/171; 138/177; 165/153; 165/166; 165/170; 165/177

[58] Field of Search ..... 138/171, 38, 116, 138/142, 177, 121; 165/170, 166, 177, 153

[56] References Cited

U.S. PATENT DOCUMENTS

| | | | |
|---|---|---|---|
| 3,502,142 | 3/1970 | McGuffey | 165/170 |
| 3,734,178 | 5/1973 | Soudron | 165/170 |
| 4,209,064 | 6/1980 | Cacalloro et al. | 165/170 |
| 5,152,337 | 10/1992 | Kawakatsu et al. | 165/153 |
| 5,439,050 | 8/1995 | Waterman et al. | 165/170 |
| 5,467,817 | 11/1995 | Schwald | 165/170 |
| 5,514,248 | 5/1996 | Okuda et al. | 165/153 |
| 5,555,933 | 9/1996 | Darragh et al. | 165/166 |
| 5,689,881 | 11/1997 | Kato | 165/177 |

FOREIGN PATENT DOCUMENTS

| | | |
|---|---|---|
| 63-17968 | 2/1988 | Japan . |
| 05018690 | 1/1993 | Japan . |

*Primary Examiner*—James F. Hook
*Attorney, Agent, or Firm*—Kanesaka & Takeuchi

[57] ABSTRACT

Heat-exchanging conduit tubes for a laminated heat exchanger made of aluminum material containing aluminum alloy having a brazing material claded and formed by folding one plate or overlaying two plates and brazing to connect edge joints of the folded plate or the overlaid plates, wherein the folded plate or the overlaid plates have projections protruded from one or both faces of the opposed plates toward the other plate, the projections are joined in contact with a flat face of the other plate or the projections of the other plate, and the edge joints of the folded plate or the overlaid plates are joined, and the height of the edge joint of the each plate is smaller than those of the projections. Thus, the heat-exchanging conduit tubes can be securely brazed to provide flat tubes having a satisfactory pressure resistance, and a method for producing them can be attained.

4 Claims, 16 Drawing Sheets

HEAT-EXCHANGING CONDUIT TUBES FOR LAMINATED HEAT EXCHANGER AND METHOD FOR PRODUCING SAME

BACKGROUND OF THE INVENTION

Field of the Invention

This invention relates to heat-exchanging conduit tubes for a laminated heat exchanger which is formed of the heat-exchanging conduit tubes such as flat tubes or flat pipes, and to a method for producing them.

Description of the Related Art

A conventional laminated heat exchanger is known that flat tubes are laminated as heat-exchanging conduit tubes, these flat tubes are connected to distributing/collecting members such as header tanks, and a heat-exchanging medium is meandered a plurality of times to flow between inlet and outlet joints disposed on the header tanks.

For this type of laminated heat exchanger, flat tubes disclosed in, e.g., (1) Japanese Patent Application Laid-open Print No. Hei 3-155422 and (2) Japanese Utility Model Application Laid-open Print No. Sho 59-59688 are used.

As shown in FIG. 18, the above (1) discloses the structure of a flat tube 25 which is made by forming many projections (beads) 27 on one plate 28 having a certain size, folding the plate 26 double from a fold 28 at the center, and brazing joints 29, 29 to connect mutually.

As shown in FIG. 19, the above (2) discloses the structure of a flat tube 30 which is made by overlaying two plates 31, 32 having many projections (beads) 27 which are protruded inward to have their ends connected to one another, and brazing joints 33, 33 at both ends of the plates 31, 32.

The flat tubes 25, 30 of the above (1) and (2) have advantages that many beads 27 cause a heat-exchanging medium to make a turbulent flow within the tubes to enhance a heat-exchanging capacity, increase the strength of the tube's flat surfaces, and improve a pressure resistance.

For the above flat tubes 25, 30, a height c from the flat surface to the respective joints 29, 33 is formed to uniformly have the same size in the breadth direction of the flat tubes, and accordingly, the beads 27 are also formed to have the same height. And, the insertion ends of each flat tube are inserted into the tube insertion ports of the header tanks and integrally brazed to be connected to the header tanks to form a heat exchanger.

FIG. 20 shows a so-called single tank type laminated heat exchanger 40 which is made by laminating many flat pipes 41 as heat-exchanging conduit tubes. For example, a plate 42 for flat pipes shown in FIG. 21 and a plate 42 for flat tubes shown in FIG. 22 are joined to make one flat pipe, which are connected with their backs in many numbers to form the heat exchanger 40. These plates 42 are formed by pressing, and provided with tank-forming recesses 43, 44 at one end, a U-shaped fluid passage 45 which is communicated with these recesses 43, 44, and a partition projection 46 for forming the U-shaped fluid passage 45. The plate 4 of FIG. 22 is further provided with a plurality of beads 47 around the partition projection 46.

As described above, the two plates 42 are joined to form a single flat pipe 41. An edge joint 48 and the partition projection 46 of the plate shown in FIG. 21 are integrally brazed with an edge joint 48 and the partition projection 46 of the plate shown in FIG. 22.

But, when the flat tubes of the above (1) and (2) are used to form a laminated heat exchanger, some of the beads disposed at the center in the breadth direction of the flat tubes are not integrally brazed, possibly causing a disadvantage that a pressure resistance of, e.g., a condenser is not satisfied.

In the integral brazing, the edge joints of the plates can be fully brazed because a brazing material is enough for the inside and outside of the plates. But, the brazing material within the plates is not enough to join the beads which are disposed at the center in the breadth direction of the flat tubes, very small gaps are formed between the beads to be joined, only the brazing material within the plates is used to join the beads, the thickness of a brazing sheet is reduced due to fusing of the brazing material layer when brazing, and the beads have various heights, so that sufficient brazing cannot be made.

Besides, the conventional flat tubes have a disadvantage that the defective brazing between the beads cannot be checked.

Furthermore, the conventional flat tubes also have the same disadvantage as above when inner fins are inserted into the flat tubes.

In addition, the above single tank type laminated heat exchanger also has disadvantages that the partition projections and the beads are defectively brazed, and the occurrence of defective brazing cannot be checked.

In view of the above, this invention aims to provide heat-exchanging conduit tubes for a laminated heat exchanger and a method for producing the same. Even the heat-exchanging conduit tubes formed by folding one plate and the heat-exchanging conduit tubes formed by joining two plates can provide a sufficient pressure resistance and an easy way of checking a possible defect in brazing by enabling to securely join the beads disposed at the center in the breadth direction of the heat-exchanging conduit tubes, the inner fins to be inserted into the heat-exchanging conduit tubes, or the partition projections disposed in the heat-exchanging conduit tubes.

SUMMARY OF THE INVENTION

This invention relates to a heat-exchanging conduit tubes for a laminated heat exchanger made of aluminum material containing aluminum alloy having a brazing material claded and formed by folding one plate or overlaying two plates and brazing to connect edge joints of the folded plate or the overlaid plates, wherein the folded plate or the overlaid plates have projections protruded from one or both faces of the opposed plates toward the other plate face, the projections are joined in contact with a flat face of the other plate or the projections of the other plate, and the edge joints of the folded plate or the overlaid plates are joined, and the height of the edge joint of the each plate is smaller than those of the projections.

And, this invention relates to a method for producing heat-exchanging conduit tubes for a laminated heat exchanger made of aluminum material containing aluminum alloy having a brazing material claded, which comprises folding a single plate which has inwardly protruded projections from its flat surface or overlaying two plates which have inwardly protruded projections from their flat surfaces, contacting the ends of the projections, and brazing to bond mutually the edges of the folded plate or the overlaid plates and the ends of the projections, wherein the height of the edge joint of the each plate is made to be smaller than those of the projections by press molding, the ends of the heat-exchanging conduit tubes are inserted into insertion ports of header tanks, and the ends of the projections and the edge joints of the folded plate or the overlaid plates are bonded by brazing.

Furthermore, this invention relates to a method for producing heat-exchanging conduit tubes for a laminated heat exchanger made of aluminum material containing aluminum alloy having a brazing material claded, which comprises folding one plate or overlaying two plates, inserting an inner fin inside and brazing to connect edge joints of the folded plate or the overlaid plates, wherein the height of the edge joint of the each plate is formed by press molding to be smaller than a half of the height of the folded plate or the overlaid plates in which the inner fin is inserted, ends of the heat-exchanging conduit tubes are inserted into insertion ports of header tanks, and the edge joints as well as the inner fin and the folded plate or the overlaid plates are bonded by brazing.

To produce these heat-exchanging conduit tubes, a jig or the like is used to laminate a plurality of heat-exchanging conduit tubes with a corrugated fin positioned between the heat-exchanging conduit tubes, brazing is made to join the projections (e.g., between beads, beads and the mating plate, the inner fin and the plate, or partition projections) of the heat-exchanging conduit tubes and the edge joints mutually.

In these heat-exchanging conduit tubes, since the height of the edge joint of the plate is made smaller than those (heights of the beads, a half of the height of the plate in which the inner fin is inserted, or the height of the partition projection) of the above projections, constraint due to assembling is particularly high at the contacts of mutual beads, the connected parts of the inner fins with the plates or the partition projections. As a result, integral brazing securely connects the projections by the brazing material which is within both plates, and the brazing material of the inside and outside of the plates enters between the edge joints to securely connect them because a gap which may be formed between the edge joints is filled with the brazing material.

Thus, the projections of the heat-exchanging conduit tubes are brazed with priority, and therefore, the beads, the beads and the mating plate, the inner fins and the plates or the partition projections can be surely brazed. As a result, the pressure resistance of the heat-exchanging conduit tubes can be improved, and they can be satisfactorily applied to a condenser. Besides, since the projections of the heat-exchanging conduit tubes are brazed with priority, a possible defect in brazing is hard to occur between the beads, the beads and the mating plate, the inner fins and the plates or the partition projections, but between the joints. If this defect occurs between the edge joints, it is found as an external leak by a visual inspection or a check, so that defective brazing can be found easily.

EMBODIMENTS

The invention will be described with reference to embodiments shown in the attached drawings.

Figure 1:
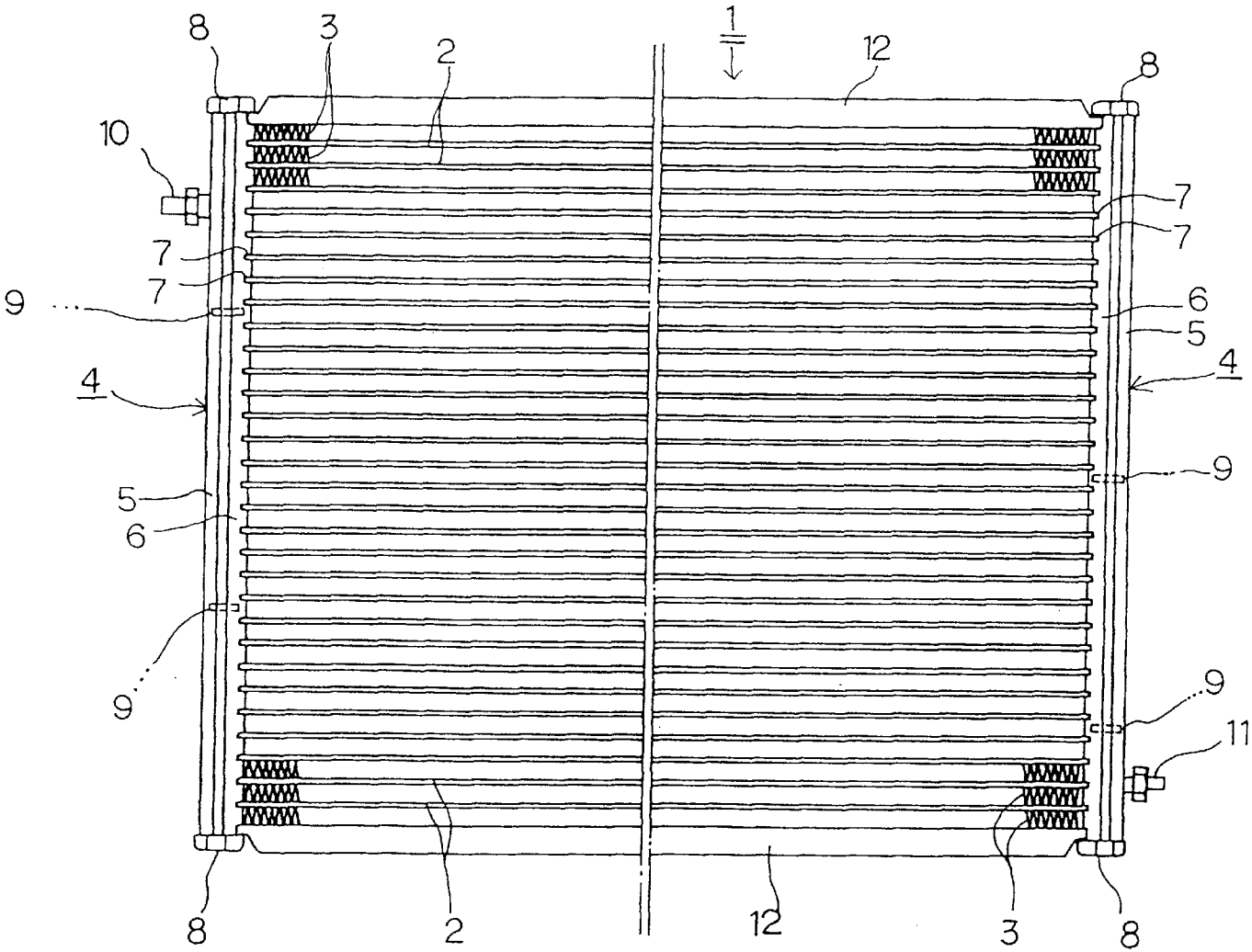
FIG. 1 is a front view of the laminated heat exchanger according to one embodiment of the invention.

In FIG. 1, a laminated heat exchanger 1 of this embodiment has a plurality of heat-exchanging conduit tubes, i.e., flat tubes 2 in this case, laminated with a corrugated fin 3 therebetween, and respective ends of the plurality of flat tubes 2 inserted into insertion ports 7 which are disposed on header tanks 4. And, top and bottom openings of each header tank 4 are sealed with a blank cap 8, and partitions 9 are disposed at prescribed positions of the each header tank 4. The header tank 4 is provided with an inlet joint 10 or an outlet joint 11, and a heat-exchanging medium is meandered a plurality of times to flow between the inlet and outlet joints 10, 11. In the drawing, reference numerals 5 and 6 designate tank plates and end plates which configure the header tanks 4, and reference numeral 12 designates side plates which are disposed at the top and bottom of the laminated flat tubes 2.

Figure 2:
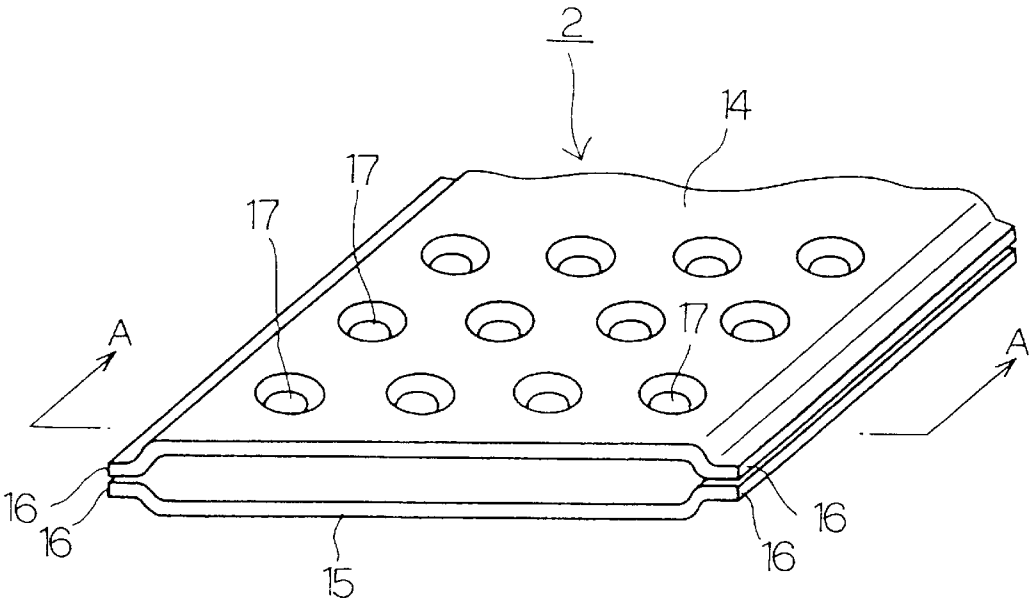
FIG. 2 is a perspective view of a flat tube.
Figure 3:
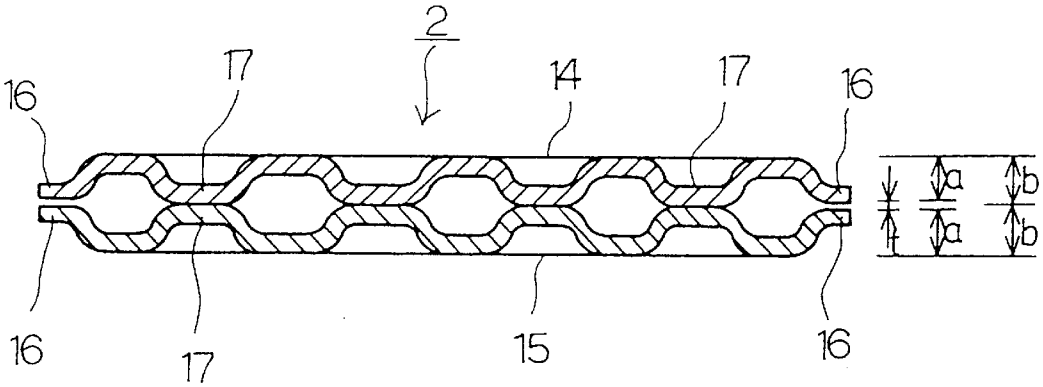
FIG. 3 is a transverse sectional view taken on line A—A of the flat tube shown in FIG. 2.
Figure 4:
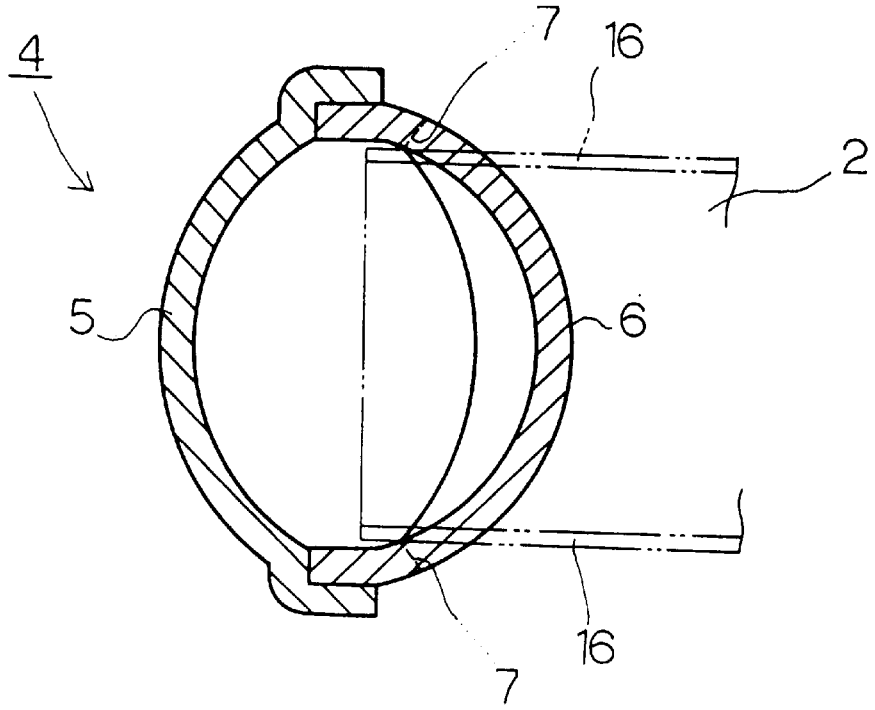
FIG. 4 is a transverse sectional view showing a flat tube which is inserted into an insertion port.

As shown in FIG. 2 and FIG. 3, the each flat tube 2 is formed by overlaying two plates 14, 15 which are pressed into a prescribed sized-shape. These plates 14, 15 have joints at both ends in a longitudinal direction, and flat faces are shaped to protrude externally, each flat face has projections which are protruded inward to contact one another, many circular beads 17 being formed in this case.

In FIG. 2, the beads 17 are formed up to the ends of the flat tube 2 which are inserted into the header tanks 4. These beads 17 work to enhance a heat-exchanging capacity by causing the heat-exchanging medium to make a turbulent flow within the tubes to enhance the heat-exchanging capacity, and increase the strength of the tube's flat surfaces to improve a pressure resistance.

In FIG. 3, the height a of the each joint 16 at both ends of the flat tube 2, i.e., a thickness between the flat surface and the joint 16, is designed to be smaller than the height b of each bead 17 formed between both edges, and the beads are formed by press working.

In this embodiment, a difference t between the height b of the bead 17 and the height a of the joint 16 is determined to be about 0.02 to 0.1 mm, for example.

In the laminated heat exchanger 1, to insert the flat tubes 2 into the insertion ports 7 of the header tanks 4, a jig is used to position the corrugated fin 3 between the flat tubes 2 and to laminate the plurality of flat tubes 2, the insertion ends of each flat tube 2 are inserted into the insertion ports 7 of the header tanks 4, and integral brazing is performed to join among the beads 17 and between the joints 16 of the flat tubes 2 and the flat tubes 2 with the insertion ports 7 of the header tanks 4.

Figure 5:
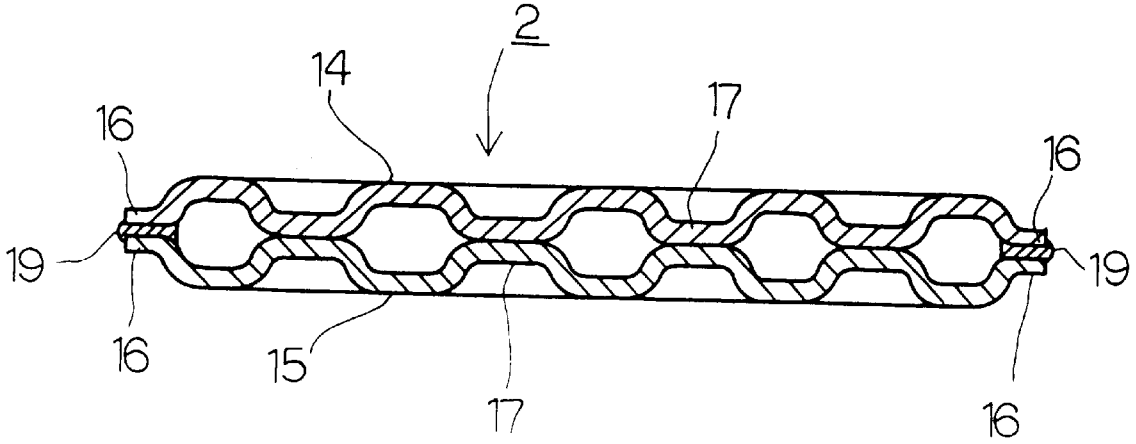
FIG. 5 is a transverse sectional view showing a brazed flat tube.

When the flat tubes 2 are inserted into the insertion ports 7 of the header tanks 4, the ends of the beads 17 are mutually contacted due to pushing pressures by the insertion ports 7, and a small gap is formed between the joints 16 at both edges because the height a of the joint 16 is smaller than the height of the beads 17. And, when integrally brazing, the beads 17 are mutually connected by the brazing material within the plates 14, 15, and as shown in FIG. 5, a blazing material 19 within and outside of the plates 14, 15 enters the gap between the joints 16, thereby securely filling the gap to join the joints 16 mutually.

According to this embodiment, therefore, since the height of the joints is made smaller than those of the beads, the beads of the flat tubes inserted into the insertion ports of the header tanks can be soldered with priority, enabling to securely braze the beads mutually. As a result, the pressure resistance of the flat tubes can be improved, and they can be satisfactorily applied to a condenser.

Besides, since the beads of the flat tubes are brazed with priority, a possible defect in brazing is hard to occur between the beads but between the joints. If this type of defect occurs between the joints, it is found as an external leak by a visual inspection or a check, so that defective brazing can be found easily.

Figure 6:
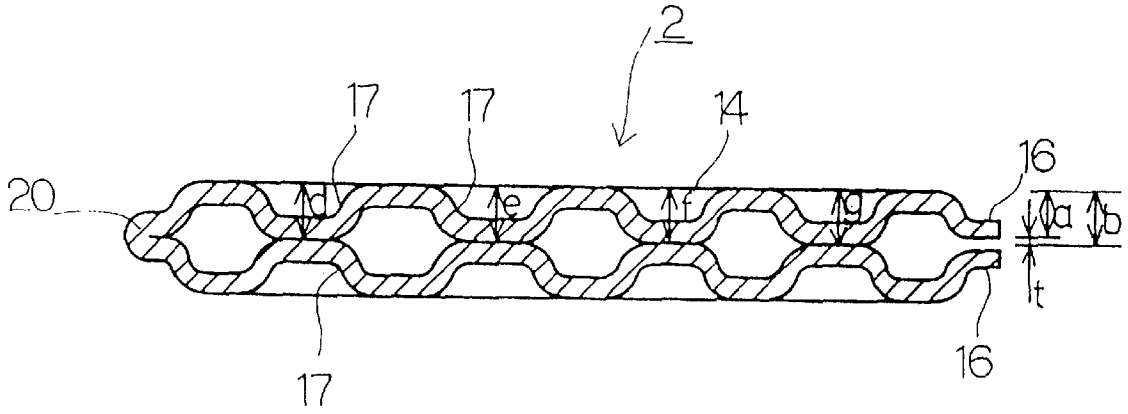
FIG. 6 is a transverse sectional view showing another embodiment of the flat tube.

The above embodiment has been described with reference to the flat tubes 2 which are formed by overlaying the two plates 14, 15, but it can be applied to a flat tube 2 which is formed by folding a single plate 14 at the middle as shown in FIG. 6. In FIG. 6, reference numeral 17 designates beads, 16 joints, and 20 a fold.

Figure 7:
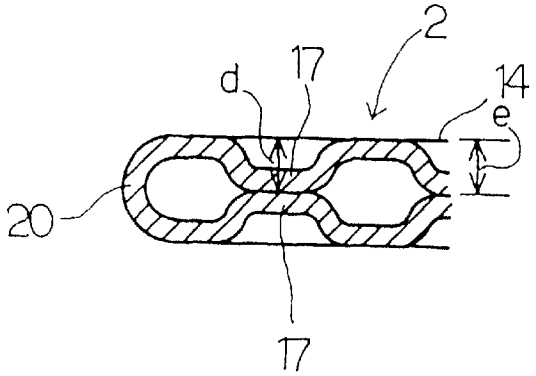
FIG. 7 is a transverse sectional view showing another embodiment of the flat tube.
Figure 8:
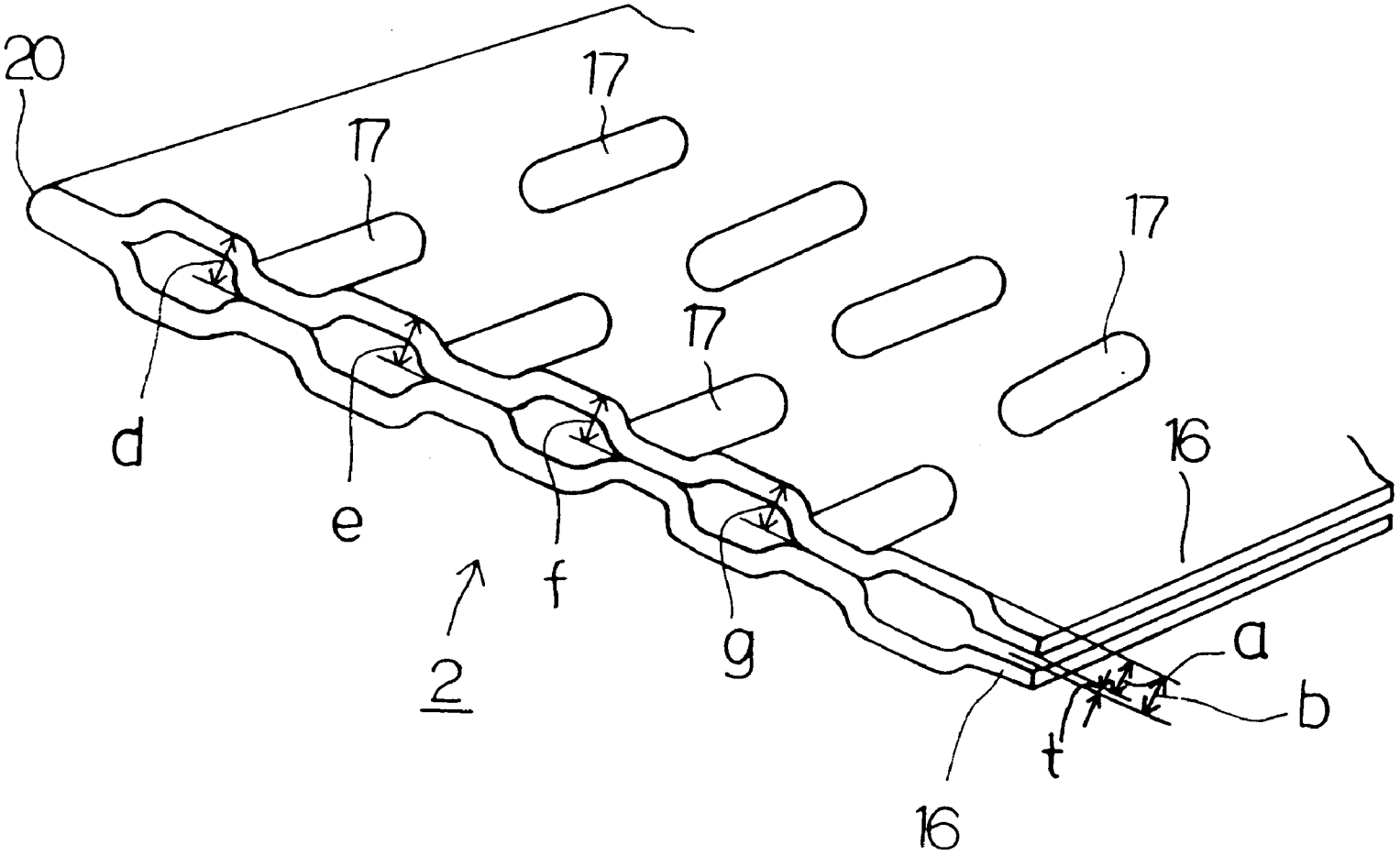
FIG. 8 is a perspective view showing another embodiment of the flat tube.

And, as to the folding type flat tubes 2, the above embodiment can be applied to a flat tube 2 whose fold 20 is curved as shown in FIG. 7.

The flat tubes 2 shown in FIG. 6 and FIG. 7 have their one edge formed of the fold 20, so that among the plurality of beads 17 in the breadth direction, the heights of respective beads 17 from the fold 20 to the joints 16 are sequentially determined to be d, e, f and g, and this order may be set to be d=e=f=g>a or d>e>f>g>a.

Furthermore, the above embodiment has been described with reference to the circular beads 17, but the beads 17 may be formed to be elliptical. And, the embodiment has brazed the beads mutually, but the beads may be brazed to be connected to the counter plate.

Figure 9:
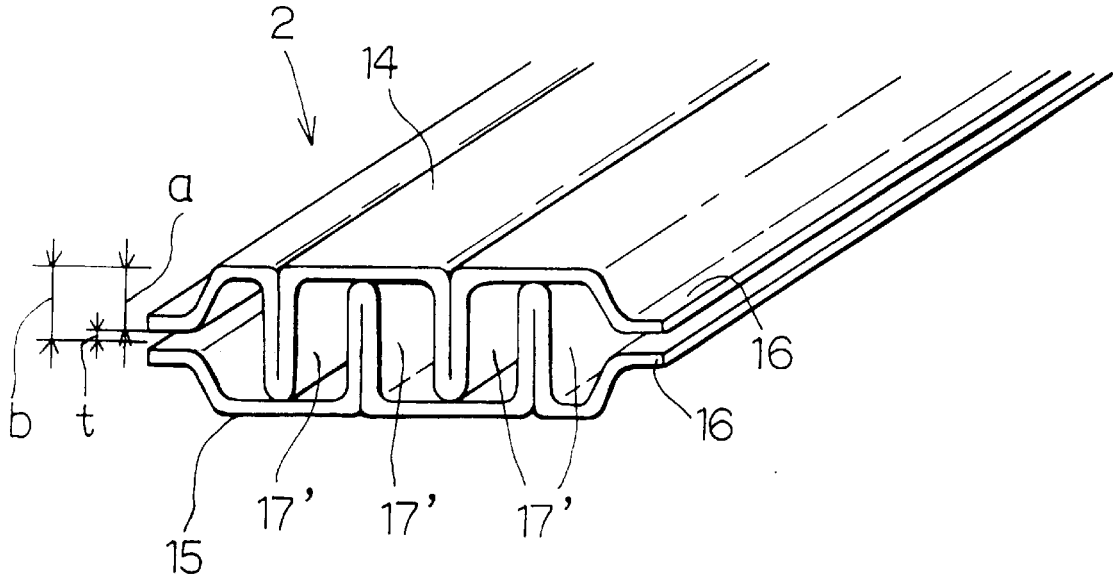
FIG. 9 is a perspective view showing another embodiment of the flat tube.
Figure 10:
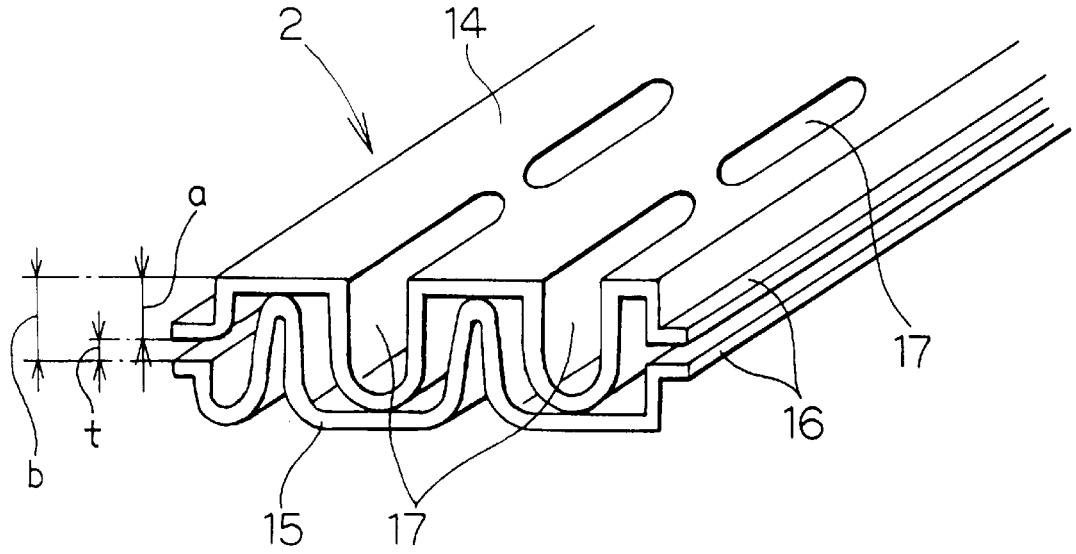
FIG. 10 is a perspective view showing another embodiment of the flat tube.
Figure 11:
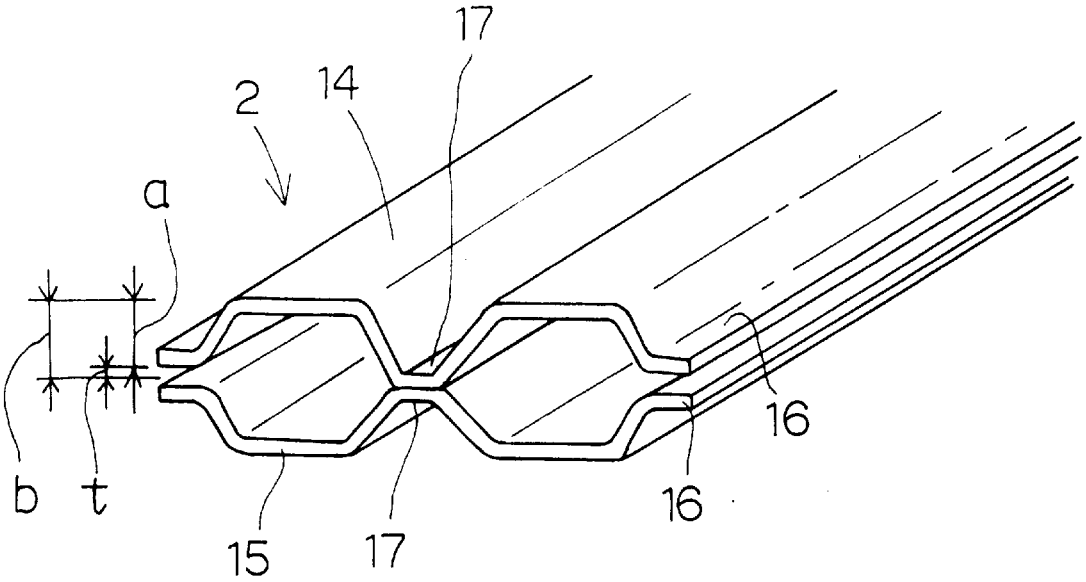
FIG. 11 is a perspective view showing another embodiment of the flat tube.

FIG. 9 to FIG. 11 show other embodiments of the invention. In these embodiments, two plates 14, 15 which are formed by pressing into prescribed-sized shapes are overlaid, and these plates 14, 15 have joints 16, 16 at both edges extended in a longitudinal direction.

FIG. 9 and FIG. 10 show that respective flat faces are formed to protrude outward, and provided with projections which are protruded inward to contact their tips to the other flat face. In these cases, folded projections 17' and beads 17 are disposed in plural numbers.

FIG. 11 shows that flat surfaces are formed to protrude outward, each flat surface is provided with a plurality of projections which are protruded inward to contact mutually. In this case, the projections are beads 17 which are bent protrusions whose opposed bent surfaces are mutually and continuously contacted.

In the embodiments shown in FIG. 9 and FIG. 10, in the same way as in the aforementioned embodiment, the height a of each joint 16 at both edges of the flat tube 2, i.e., the thickness from the flat surface to the joint 16, is formed to be smaller than a half size b of the tube thickness. Also, in the embodiment of FIG. 11, the height a is smaller than the height b of each bead 17. These embodiments have been described with reference to the flat tubes which are formed by overlaying two plates 14, 15 as the flat tube 2. But, these embodiments can be applied to a flat tube which is formed by folding a single plate at the center.

Thus, the embodiments shown in FIG. 9 through FIG. 11 have the same effects as the aforementioned embodiment.

Figure 12:
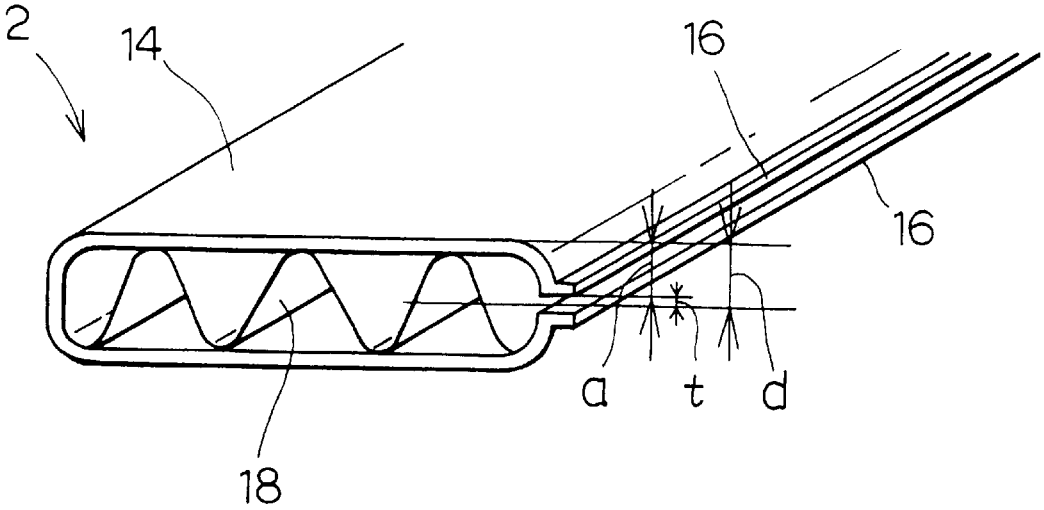
FIG. 12 is a perspective view showing another embodiment of the flat tube.
Figure 13:
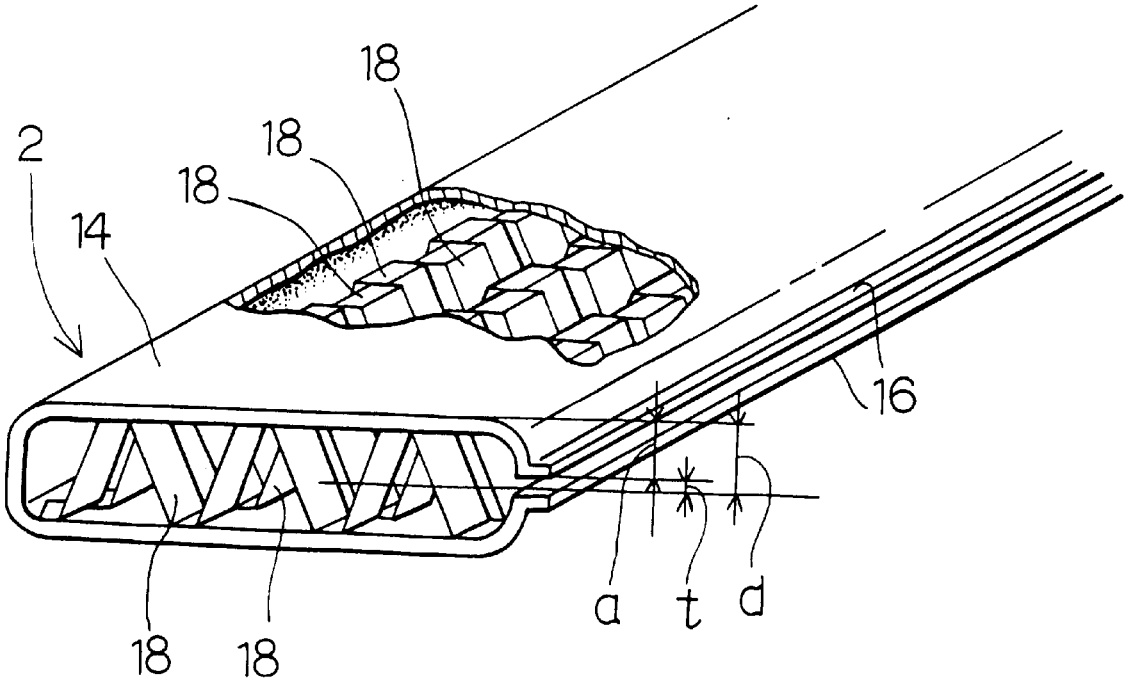
FIG. 13 is a perspective view showing another embodiment of the flat tube.

FIG. 12 and FIG. 13 show other embodiments of the invention. In these embodiments, in the same way as in the first embodiment, a single plate 14 which is formed into a prescribed sized-shape by pressing is folded at the center, the plate 14 has joints 16, 16 at one edge along a longitudinal direction, and an inner fin 18 is inserted into the folded plate 14.

FIG. 12 shows that the inner fin 18 is single and long, the height a at the edge joints of the plate 14 is smaller than a half size d of the height of the folded plate 14 in which the inner fin 18 is inserted. Both ends of the flat tube 2 are inserted into and brazed with insertion ports 7 of header tanks 5, 6 which are distributing/collecting members, thus the edge joints of the plate are joined and the inner fin 18 is connected to the plate 14.

FIG. 13 shows that many inner fins 18 are disposed in a longitudinal direction, and the adjacent inner fins 18, 18 are mutually deviated in the breadth direction. Since the adjacent inner fins 18, 18 are mutually deviated in the breadth direction, a heat-exchanging medium flowing within the tube is subject to turbulence to enhance a heat-exchanging capacity, and the inner fins 18 work to enhance the strength of the flat surfaces of the tube and improve a pressure resistance. And the height a at the edge joint of the plate is smaller than a half size d of the height of the folded plate 14 in which the inner fins 18 are inserted, and both ends of the flat tube 2 are inserted into and brazed with insertion ports 7 of header tanks 5, 6, thus the edge joints of the plate are joined and the inner fins 18 are connected to the plate 14.

The embodiments shown in FIG. 12 and FIG. 13 also have the same effects as the aforementioned embodiments. These embodiments of FIG. 12 and FIG. 13 have been described with reference to the flat tubes which are formed by folding a single plate at the center. But, these embodiments can be applied to a flat tube which is formed by overlaying two plates 14, 15.

Figure 14:
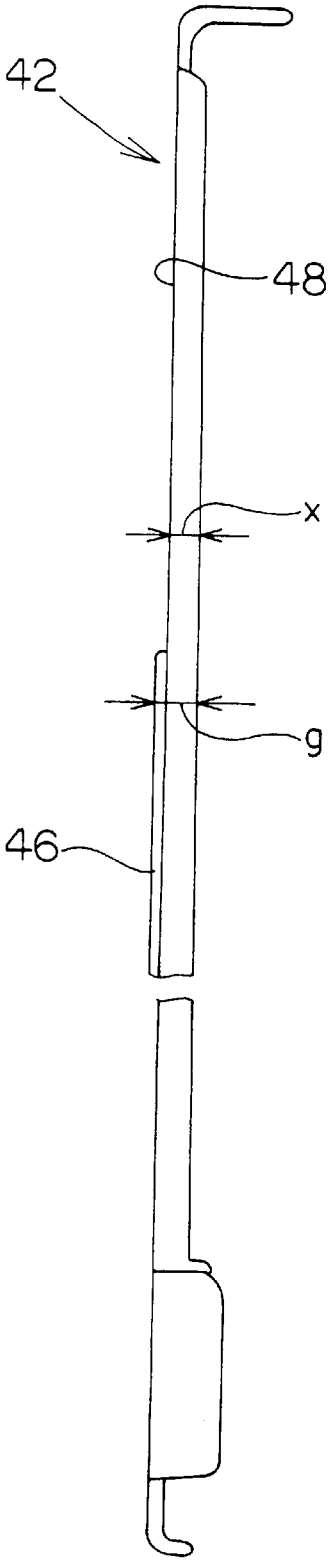
FIG. 14 is a central vertical sectional view of the flat tube.
Figure 21:
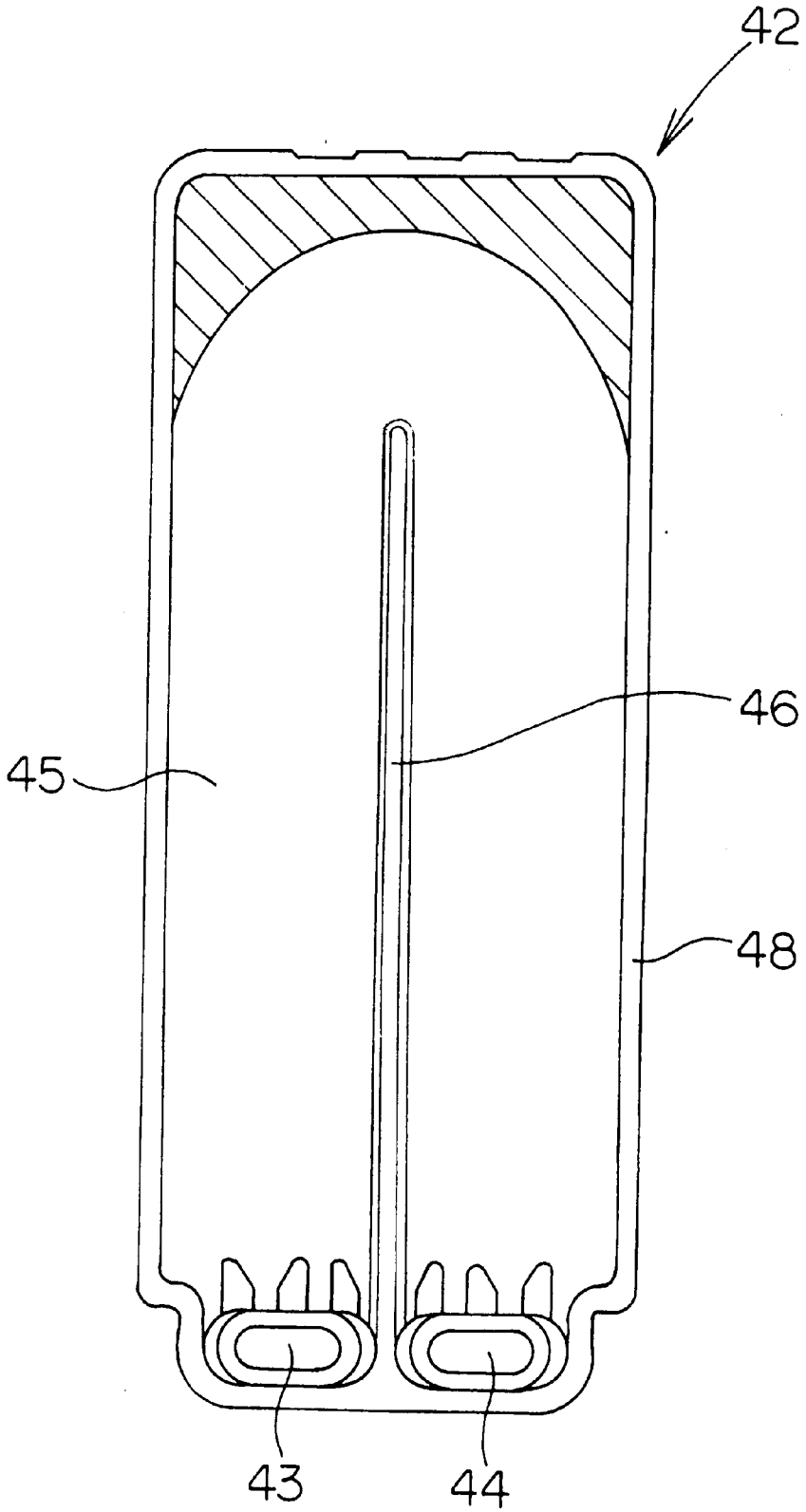
FIG. 21 is a diagram showing a plate configuring a flat pipe.

FIG. 14 shows that the height x of the edge joint 48 of the plate 42 shown in FIG. 21 is made smaller than the height y of the partition projection 46. Therefore, when two plates 42 are joined to form one flat pipe 41, constraint due to assembling is particularly high at the partition projection 46 which is protruded. As a result, integral brazing securely connects the projections by means of the brazing material which is within both plates, and the brazing material of the inside and outside of the plates 42 enters between the edge joints 48 to securely connect them because a gap which may be formed between the edge joints 48 is filled with the brazing material.

Figure 15:
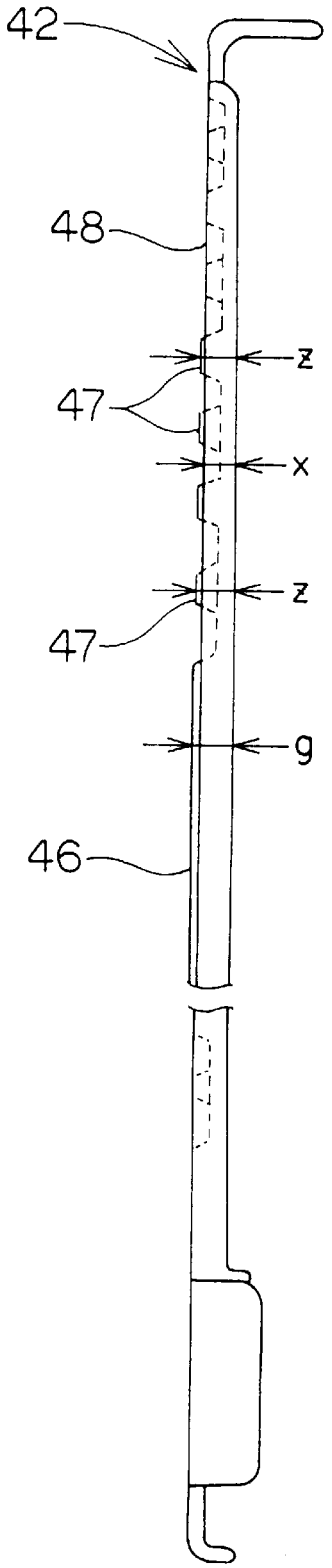
FIG. 15 is a central vertical sectional view of another embodiment of the flat tube.
Figure 22:
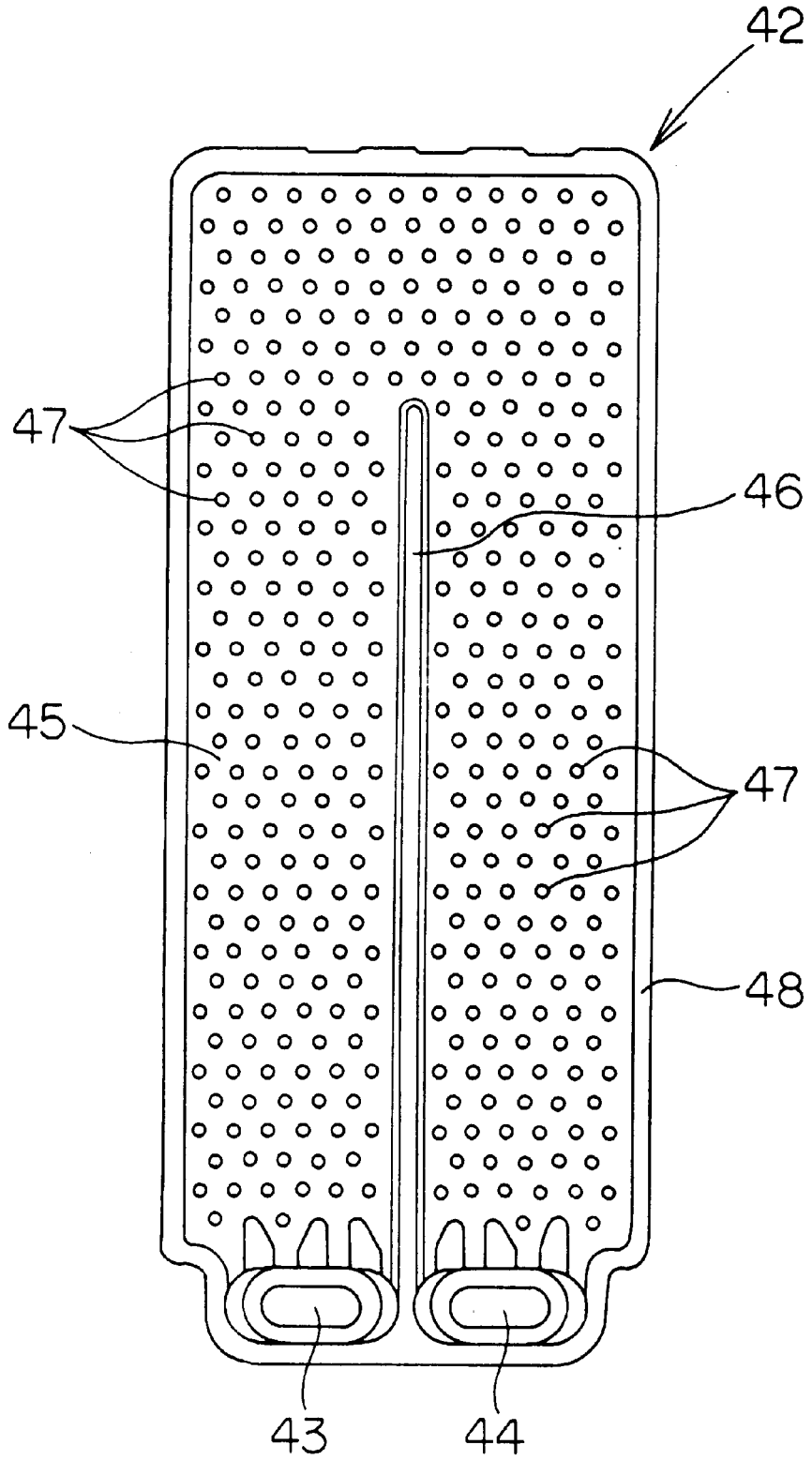
FIG. 22 is a diagram showing a plate configuring a flat pipe.

FIG. 15 shows that the height x of the edge joint 48 of the plate 42 shown in FIG. 22 is made smaller than the height y of the partition projection 46 and the height z of the bead 47. There are two variations that the height y of the partition projection 46 is made equal to the height z of the bead 47 and that the height z of the beads 47 and the height x of the edge joint are gradually decreased to be smaller than the height y of the partition projection 46. In either case, the height y of the partition projection 46 is highest, so that when two plates 42 are joined to form one flat pipe 41, constraint due to assembling is particularly high at the partition projection 46 which is protruded. As a result, integral brazing securely connects the projections by means of the brazing material which is within both plates, and the brazing material of the inside and outside of the plates 42 enters between the edge joints 48 to securely connect them because a gap which may be formed between the edge joints 48 is filled with the brazing material.

The plates 42 shown in FIG. 14 and FIG. 15 generally have a poor brazing property at the end of the partition projection 46 (the top end of the partition projection 46 in the drawings), so that this part is preferably formed to have the largest size.

Brazing of the laminated heat exchanger 1 having the above structure will be described.

The laminated heat exchanger 1 is assembled by positioning the corrugated fin 3 between the flat tubes 2 using a jig, laminating the plurality of flat tubes 2, and inserting the insertion ends of each flat tube 2 into the insertion ports 7 of the header tanks 4.

Figure 16:
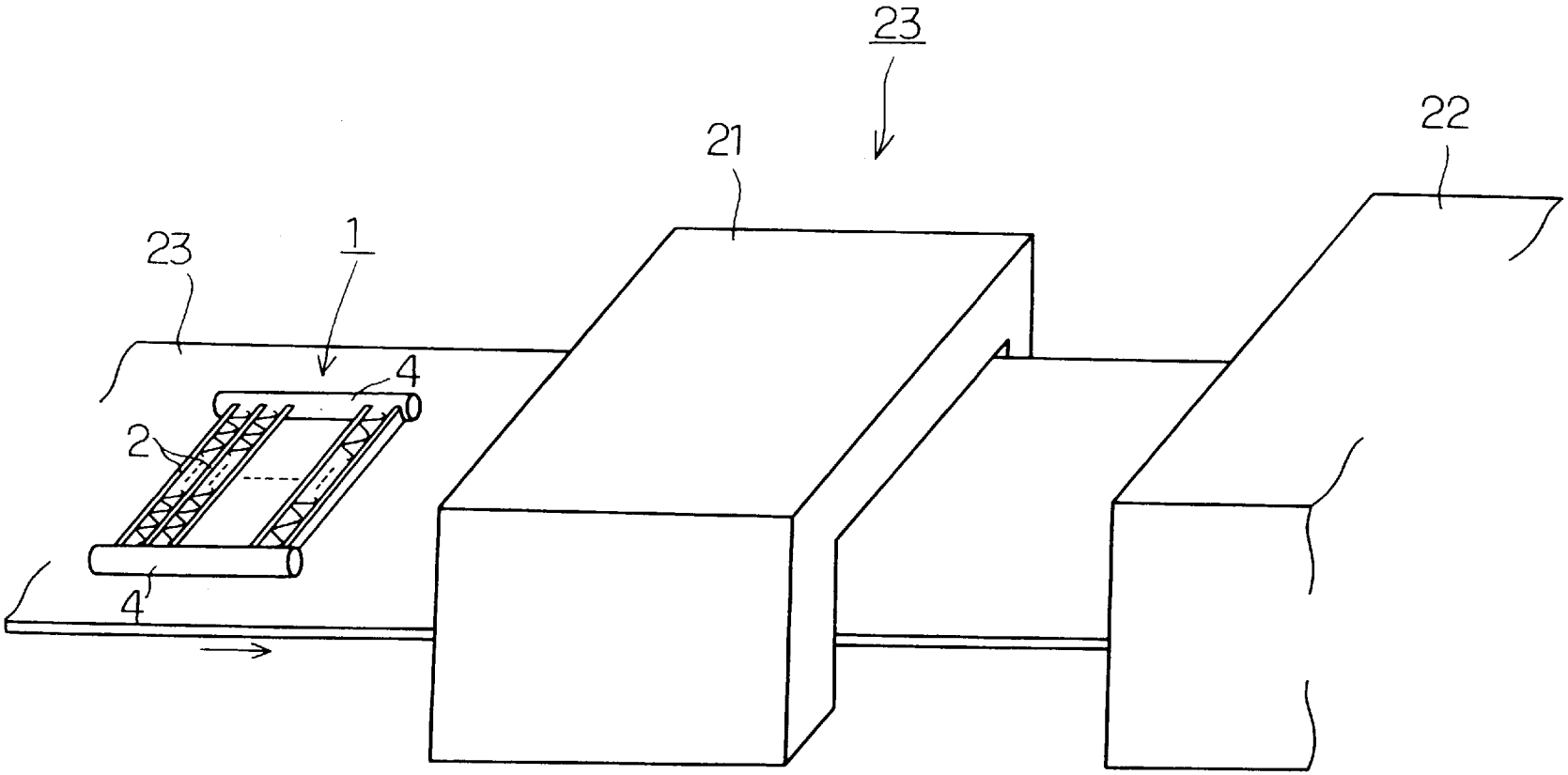
FIG. 16 is a perspective view schematically showing a blazing device for heat exchangers.

For integral brazing of the assembled heat exchanger 1, a brazing device 23 shown in FIG. 16 is used. The brazing device 23 comprises a flux applicator 21 which downwardly sprays liquid flux on the heat exchanger 1, a brazing furnace 22 which gradually increases a temperature of the flux-applied heat exchanger 1 and cools it, and a belt conveyor 23 which carries the heat exchanger I through the above means.

Figure 17:
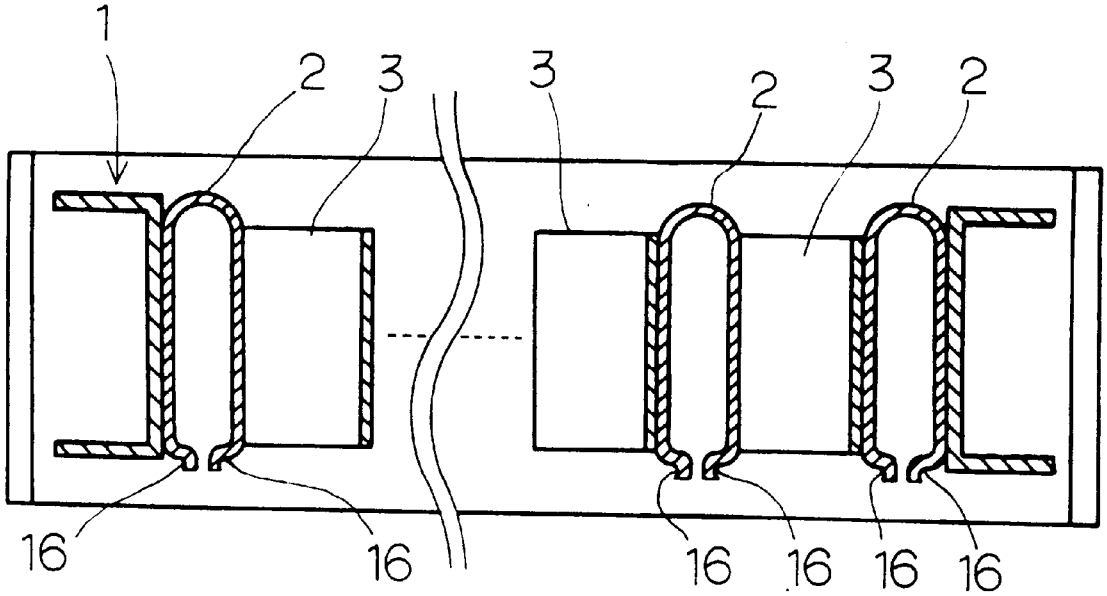
FIG. 17 is a sectional view showing a heat exchanger being carried.
Figure 18:
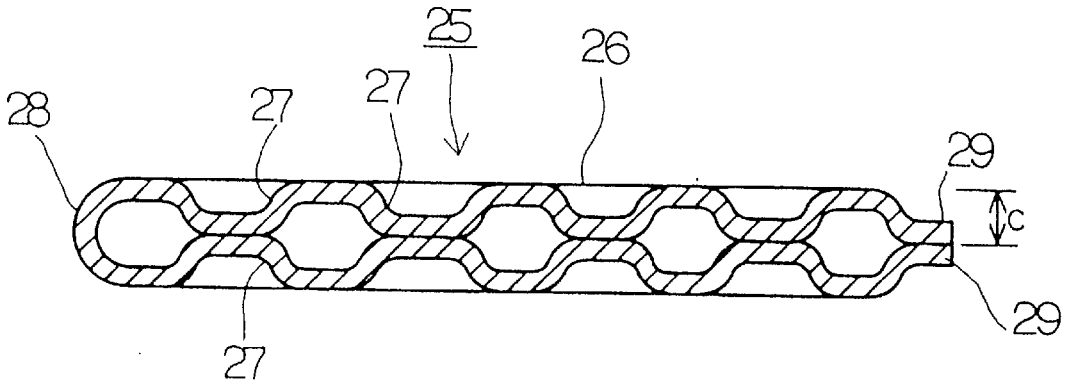
FIG.18 PRIOR ART
FIG. 18 is a transverse sectional view showing a folding type flat tube according to a prior art.
Figure 19:
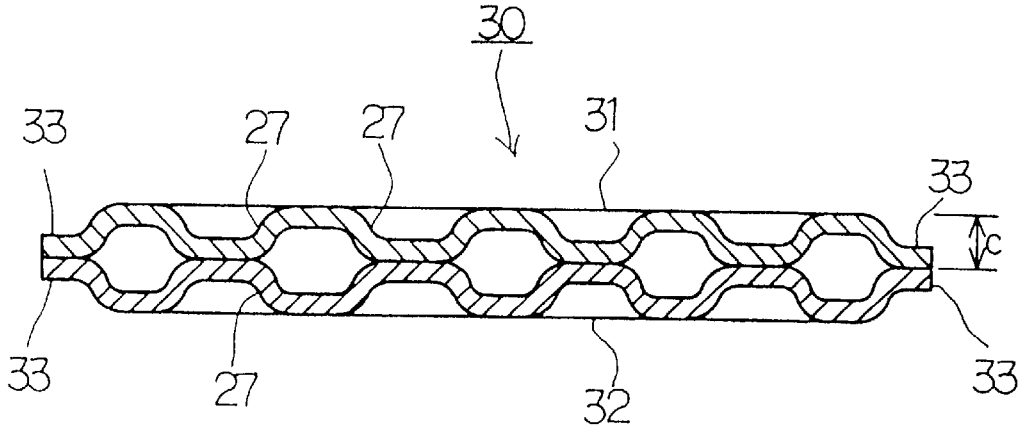
FIG.19 PRIOR ART
FIG. 19 is a transverse sectional view showing an overlaying type flat tube according to a prior art.
Figure 20:
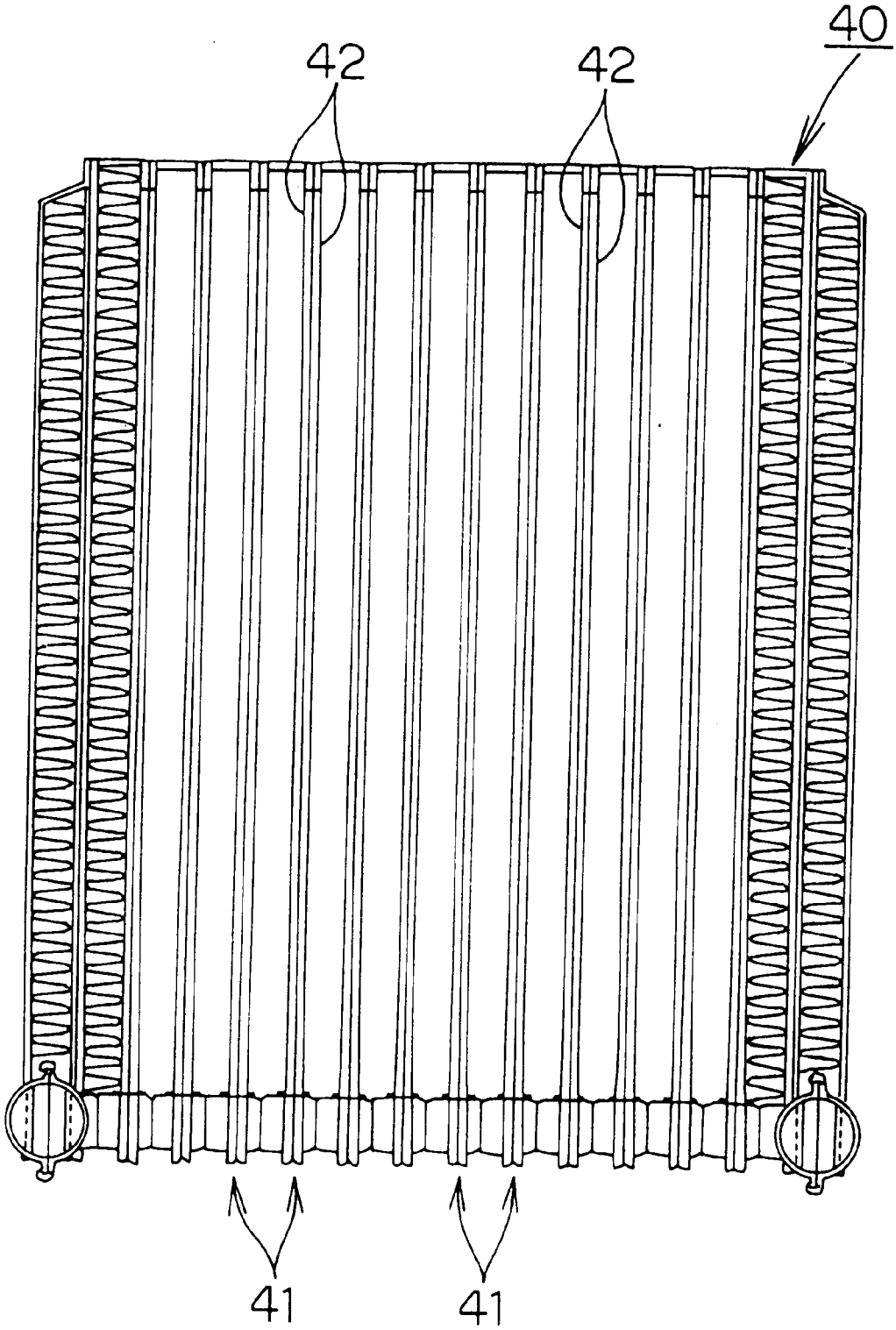
FIG. 20 is a front view of a single tank type laminated heat exchanger.

To place the heat exchanger 1 on the belt conveyor 23, both header tanks 4 are laid on the belt conveyor 23 as also shown in FIG. 17.

The heat exchanger 1 coated with the flux is carried by the belt conveyor 23 to the brazing furnace 22 where it is integrally brazed. In this case, a gap between the joints 16, 16 of the flat tube is filled with the molten brazing material to connect the joints 16, 16 mutually, and other parts are also brazed to form the heat exchanger 1.

When the joints 16 of the flat tube 2 are at one edge only, the heat exchanger 1 is placed and carried such that the joints 16 are faced downward. Thus, the brazing material of the inside and outside of the folded plate fills the gaps between the joints to securely connect them.

We claim:

1. Conduit tubes for a condenser made of aluminum material containing aluminum alloy having a brazing material clad and formed by folding a single plate which has inwardly protruded projections from its flat surface or by overlaying two plates which have inwardly protruded projections from their flat surfaces, and contacting the ends of said projections with those of opposed projections and brazing to bond edges of the folded plate or the overlaid plates and the ends of said projections to those of the opposed projections, wherein the height of the edge joint of each plate is smaller than those of said projections to form a gap between the edge joint, ends of the heat-exchanging conduit tubes are inserted into insertion ports of distributing/collecting members, and the ends of said projections and said edge joints of said folded plate or the overlaid plates are brazed to be bonded to those of the opposed plate.

2. A method for producing conduit tubes for a condenser made of aluminum material containing aluminum alloy having a brazing material clad, which comprises the steps of:

folding a single plate which has inwardly protruded projections from its flat surface or overlaying two plates which have inwardly protruded projections from their flat surfaces so as to contact mutual ends of said projections, and brazing said folded or overlaid plates to bond mutual edges of the plates and mutual ends of said projections, wherein the height of the edge joint of each plate is made smaller than those of said projections to form a gap between the edge joint, ends of the heat-exchanging conduit tubes are inserted into insertion ports of header tanks, and the mutual ends of said projections and said edge joints of said folded plate or the overlaid plates are bonded by brazing.

3. Conduit tubes for a condenser made of aluminum material containing aluminum alloy having a brazing material clad and formed by folding one plate or overlaying two plates, inserting an inner fin inside and brazing to connect edge joints of the folded plate or the overlaid plates, wherein the height of the edge joint of each plate is formed to be smaller than a half of the height of said folded plate or said overlaid plates in which said inner fin is inserted to form a gap between the edge joint, ends of the heat-exchanging conduit tubes are inserted into insertion ports of distributing/collecting members, and said edge joints as well as said inner fin and said folded plate or the overlaid plates are brazed to be bonded.

4. A method for producing conduit tubes for a condenser made of aluminum material containing alloy having a brazing material clad, which comprises the steps of:

folding one plate or overlaying two plates to form a tubular body, inserting an inner fin inside said tubular body to form a tube assembly, and brazing said tube assembly to connect edge joints of the folded plate or the overlaid plates, wherein the improvement comprising the steps of:

making the height of the edge joint of said each plate smaller than a half of the height of said folded plate or the overlaid plates in which said inner fin is inserted to form a gap between the edge joint, inserting ends of the heat-exchanging conduit tubes into insertion ports of header tanks, and brazing said edge joints of said folded plate or the overlaid plates and said inner fin for bonding.

* * * * *